United States Patent [19]

Bollmer

[11] 4,068,587

[45] Jan. 17, 1978

[54] PRINTING BLANKET HOLDING APPARATUS

[75] Inventor: Jacob A. Bollmer, Dayton, Ohio

[73] Assignee: Dayco Corporation, Dayton, Ohio

[21] Appl. No.: 771,588

[22] Filed: Feb. 24, 1977

[51] Int. Cl.[2] ..... B41F 29/04
[52] U.S. Cl. ..... 101/415.1
[58] Field of Search ..... 101/415.1, 407 R, 407 A, 101/127.1, 128.1

[56] References Cited

U.S. PATENT DOCUMENTS

| | | | |
|---|---|---|---|
| 3,410,211 | 11/1968 | Grunig | 101/415.1 |
| 3,788,216 | 1/1974 | Lambert | 101/415.1 X |
| 3,844,214 | 10/1974 | Smith | 101/415.1 |

*Primary Examiner*—R.E. Suter
*Attorney, Agent, or Firm*—Reuben Wolk

[57] ABSTRACT

Apparatus for holding an end of a printing blanket on an associated printing cylinder is provided and employs an elongate holding bar and bar support which cooperate to prevent damage to the blanket at locations adjacent where the holding bar engages the blanket and such apparatus has means for quickly attaching and detaching the holding bar in the bar support.

13 Claims, 5 Drawing Figures

PRINTING BLANKET HOLDING APPARATUS

BACKGROUND OF THE INVENTION

Offset printing presses of the type used in lithographic printing usually employ printing blankets each fastened around the periphery of an associated printing roll or cylinder, for the purpose of picking up an ink design or image deposited thereon by an inking roller or master for transfer onto an article being printed such as paper, or the like. Each printing blanket is held on its associated cylinder by fastening opposite ends of the blanket thereagainst using various techniques. For example, in some applications the leading end portion of the blanket is suitably fixed to a holding bar which is detachably mounted to the cylinder whereupon the printing blanket is wrapped around such cylinder and the trailing end portion, which is also fixed to a holding bar, is then also suitably detachably fastened in position on the cylinder employing a rotatable reel-like mechanism which is often popularly referred to as a reel rod. In some applications the leading end portion of the blanket is also fastened on the cylinder using a reel rod. However, a problem with printing blanket holding apparatus proposed heretofore is that there is a great tendency for damage to or failure of the blanket at locations adjacent the holding bar.

SUMMARY

It is a feature of this invention to provide a simple and economical apparatus for holding an end portion of a printing blanket against an associated cylinder with minimum likelihood of damage to or failure of such printing blanket.

Another feature of this invention is to provide apparatus for holding an end portion of a printing blanket on an associated printing cylinder wherein such apparatus employs an elongate holding bar and a bar support which cooperate to prevent damage to the blanket at locations on the blanket adjacent the holding bar and wherein such apparatus includes means for quickly attaching and detaching the holding bar in the bar support.

Another feature of this invention is to provide improved apparatus of the character mentioned which employs an improved blanket holding bar support which has an extension shelf which assures that concentrated loads are not transferred to the printing blanket adjacent the holding bar.

Accordingly, it is an object of this invention to provide a printing blanket holding apparatus having one or more of the novel features set forth above or hereinafter shown or described.

Other details, features, objects, uses, and advantages of this invention will become apparent from the embodiments thereof presented in the accompanying specification, claims, and drawing.

BRIEF DESCRIPTION OF THE DRAWING

The accompanying drawing shows a present preferred embodiment of this invention, in which.

DESCRIPTION OF ILLUSTRATED EMBODIMENT

Figure 5:
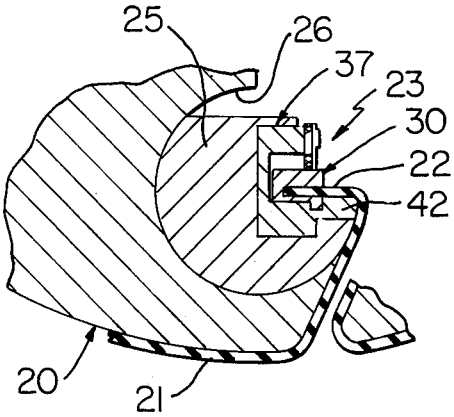
FIG. 5 is a fragmentary cross-sectional end view of a portion of a printing cylinder showing a trailing end portion of a printing blanket held in position thereon by holding apparatus of this invention.

Reference is now made to FIG. 5 of the drawing which illustrated a fragmentary portion of an exemplary printing press cylinder 20 which is particularly adapted to be installed in a printing press of known construction and the printing cylinder 20 has a printing blanket 21 suitably disposed therearound and held tautly in position in a manner which is well known in the art. In particular, the blanket 21 has a leading end portion (not shown) which is suitably detachably fastened to the cylinder 20 and a trailing end portion 22 which is detachably fastened in position on the cylinder 20 employing holding apparatus of this invention which is designated generally by the reference numeral 23. The exemplary cylinder 20 has a so-called reel rod 25 suitably supported for rotation within a cylindrical recess 26 of the cylinder and the holding apparatus 23 is provided on the reel rod 25 and in this example holds the trailing end 22 of the printing blanket 21 on the cylinder 20. In some printing presses, cylinders having so-called double reel rods are used whereby the apparatus 23 of this invention is preferably used to fasten both the leading end and the trailing end portions of a printing blanket in position thereon.

Figure 1:
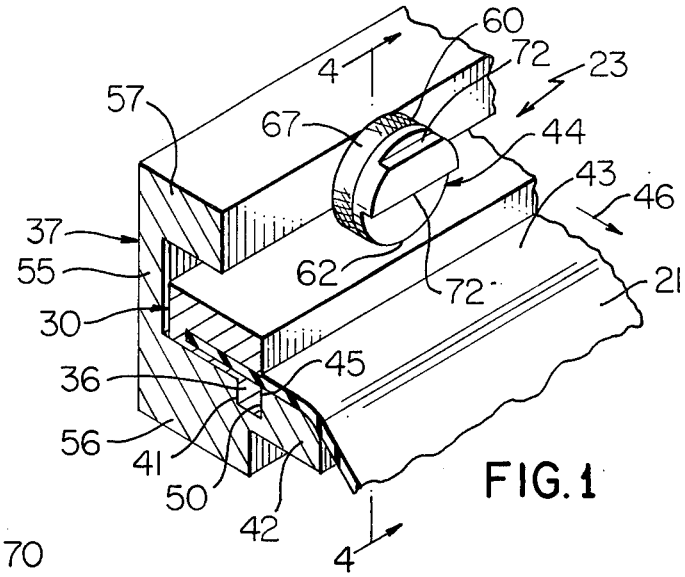
FIG. 1 is a perspective view with parts in cross-section and parts broken away illustrating printing blanket holding apparatus of this invention.
Figure 3:
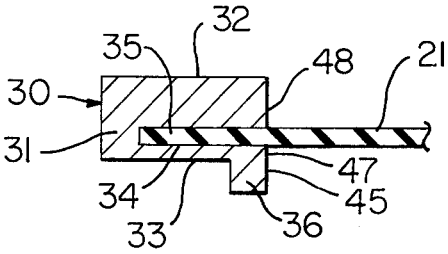
FIG. 3 is a cross-sectional view of the printing blanket holding bar of FIG. 1 and illustrating an end portion of the blanket fixed in position therewithin.

Referring now to FIGS. 1 and 3 it will be seen that the apparatus 23 comprises a elongate holding bar 30 of roughly U-shaped cross-sectional outline having a bight 31 and a pair of substantially equal length legs 32 and 33 extending from opposite ends of the bight 31 with the legs 32 and 33 defining a channel 34 therewithin for receiving an end portion 35 of the printing blanket 21. The holding bar 30 has a projection 36 extending perpendicularly from a terminal end portion of one of its legs, and in this example projection 36 extends perpendicularly from leg 32. The holding bar 30 has suitable means, of any known construction, for holding the end portion 35 of blanket 21 firmly within its channel 34.

Figure 2:
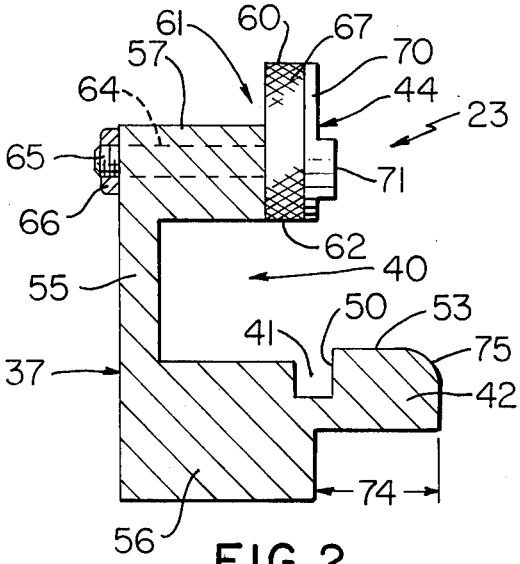
FIG. 2 is a cross-sectional view of a blanket holding bar support of the apparatus of FIG. 1 and showing quick attach means thereof.

As best seen in FIGS. 1 and 2 the holding apparatus 23 also comprises a metallic blanket holding bar adapter which will be referred to hereinafter as a bar support 37 and such support is adapted to be suitably detachably fixed to the reel rod 25 utilizing any suitable technique known in the art.

The bar support 37 has a space 40 therein which is particularly adapted to receive the holding bar 30 therewithin. The bar support 37 also has a groove 41 defined therein for receiving the projection 36 therewithin and such bar support has an extension shelf 42 extending outwardly of the groove 41 for supporting a part, shown as part 43 in FIGS. 1 and 4, of the blanket 21 thereon in spaced relation from the projection 36 on leg 32 of the holding bar 30. The holding apparatus also has quick attach means designated generally by the reference numeral 44 for quickly attaching and quickly detaching the holding bar 30 on the bar support 37. The bar support 37 and quick attach means 44 will be described in more detail subsequently.

As seen in FIG. 3, the projection 36 extending from leg 32 of the holding bar 30 has a bearing surface 45 disposed perpendicular to the end portion 35 of the blanket 21 and the bearing surface 45 serves to carry loads applied against the blanket and generally tending to pull the holding bar out of the bar support 37 and as indicated by the arrow 46 in FIG. 1. The bearing surface 45 is disposed substantially coplanar with a plane adjoining end surfaces 47 and 48 of the legs 32 and 33 respectively and it will be seen that the lower part of projection 36 is of substantially U-shaped outline with the bearing surface 45 defining an outside surface of such projection.

The groove 41 in the bar support 37 is also of U-shaped outline which corresponds to the outline of the lower part of projection 36 and it will be seen that the projection 36 fits smoothly and snugly within the groove 41. The groove 41 has what will be referred to as a forward planar surface 50 which is particularly adapted to receive and support the surface 45 whereby loads tending to pull the printing blanket 21 out of groove 40 are transmitted by surface 45 against surface 50 to the bar support 37.

Figure 4:
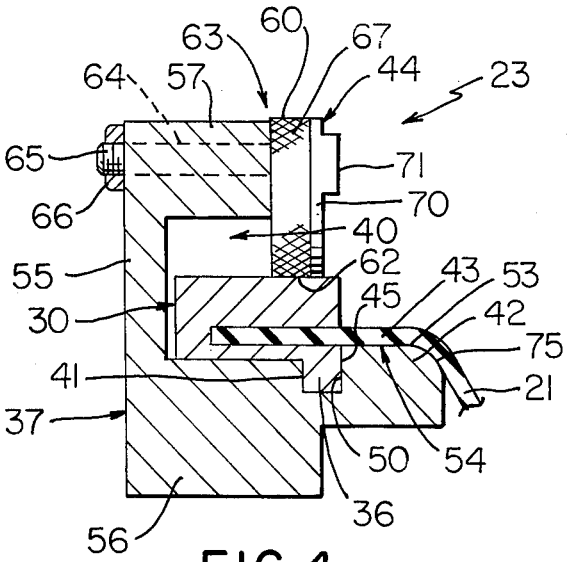
FIG. 4 is a cross-sectional view taken essentially on the line 5—5 of FIG. 2.

Referring now to FIG. 4 it will be seen that the extension shelf 42 of bar support 37 has a blanket supporting surface which is designated generally by the reference numeral 53 and surface 53 is disposed outwardly of the groove 51. Once the holding bar 30 is detachably fastened in position with the end portion 35 of the blanket 33 within such holding bar it will be seen that the inside surface of the blanket is disposed substantially coplanar with the surface 53 and as illustrated at 54.

The bar support 37 is also of roughly U-shaped cross-sectional outline, see FIG. 2, and has a bight 55 and a pair of parallel arms 56 and 57 extending from opposite ends of the bight 55. The extension shelf 42 extends from the central portion of the arm 56 and it will be seen that the space 40 is defined between the arms 56 and 57; and, the bight 55, arms 56–57, and extension 42 are defined as a single-piece structure.

As previously mentioned the apparatus 23 has quick attach means 44 for attaching and detaching the holding bar 30 on the cylinder 20 in a quick and efficient manner. The attach means 44 comprises eccentric means in the form of an eccentrically mounted circular disc 60 with the disc 60 being adapted to be rotated in one position 61 illustrated in FIG. 2 so that a lower surface 62 thereof is disposed out of engagement with holding bar 30 to be installed in space 40. Once the bar 30 is installed in position within space 40, disc 60 is adapted to be rotated substantially 180° from the position 61 in FIG. 2 to the position 63 of FIG. 4 to engage the holding bar 30 and hold such bar firmly in position.

The disc 60 of the attach means 44 is suitably mounted for free rotation on the bar support 37 and in particular is mounted for free rotation on the arm portion 57 of such bar support. The disc 60 has a shaft 64 which has a smooth outside surface along practically its entire length and the shaft 64 is suitably fixed to the disc 60 at one end and has an opposite end portion provided with external threads 65 over a short length thereof for threaded engagement with an internally threaded nut 66 for the purpose of holding the disc 60 against axial movement at the terminal outer end of the arm 57 while allowing free rotation relative thereto.

The disc 60 has means providing a comparatively high frictional engagement when disposed against the holding bar 30 and in particular such means is in the form of a knurled cylindrical portion 67 provided on and comprising a part of the axial height of the circular disc 60. The knurled portion 67 may be provided utilizing any technique known in the art.

The disc 60 may also comprise a plain unknurled portion 70 which has a protrusion 71 provided with a pair of spaced parallel ledges 72. The ledges 72 are particularly adapted to receive a tool such as a wrench, or the like, for forcible rotating the knurled portion 67 of the disc into and out of frictional engagement with the holding bar 30.

As mentioned earlier the extension shelf 42 of bar support 37 extends from the central portion of the arm 56 as previously described. The amount that shelf 42 extends from the terminal end of the arm 56 will vary depending upon the application of the apparatus 23. In general, the shelf 42 extends a distance 74 which is sufficient to assure that with the reel rod 25 in position, there is minimum stress imposed on the blanket 21. In addition, it will be seen that the extension shelf 42 preferably has an arcuate or smooth curved terminal surface 75 which serves to assure that the blanket 21 is wrapped therearound with minimum stress concentration.

In this disclosure of the invention, the apparatus 23 is shown as being suitably fixed in a reel rod 25 of a printing cylinder 20; however, it will be appreciated that the holding apparatus 23 of this invention can be used as desired and need not necessarily be fixed to a reel rod because such apparatus 23 may be used in applications in which a reel rod is not employed. Further, the apparatus 23 of this invention may be used to hold not only the trailing end portion of a blanket in position but also the leading end portion, if desired, and, may be used in a printing cylinder having a so-called double reel rod.

In this disclosure of the invention, the printing blanket 21 has been illustrated by cross hatching in the drawings as being made of rubber; however, it will be appreciated that this has been done for ease of presentation and it is to be understood that the blanket may be made using suitable known materials and such blanket may be suitably reinforced utilizing materials and techniques which are known in the art.

In this disclosure of the invention only one quick attach means 44 is shown on the bar support 37; however, it will be appreciated that in actual practice a plurality of such attach means is preferably employed along the bar support 37 to detachably fasten the blanket holding bar 37 in position.

While present exemplary embodiments of this invention, and methods of practicing the same, have been illustrated and described, it will be recognized that this invention may be otherwise variously embodied and practiced within the scope of the following claims.

What is claimed is:

1. Apparatus for holding an end portion of a printing blanket on an associated cylinder comprising; an elongate holding bar of roughly U-shaped cross-sectional outline having a pair of substantially equal length legs defining a channel for receiving said end portion of said blanket therewithin, said legs having planar outside surfaces, one of said legs having a projection extending perpendicularly from a terminal end portion of its planar outside surface, said projection having a lower portion of substantially U-shaped outline, and said projection having a bearing surface disposed perpendicular to said end portion of said blanket with said bearing surface being defined by a leg of the U-shaped outline of said lower portion; and a bar support for installation on said cylinder, said bar support having a roughly U-shaped cross-sectional outline and having a bight and a pair of parallel arms extending from opposite ends of said bight with said bight and arms defining a space in said bar support for receiving said holding bar therewithin, said bar support having a groove therein for receiving said projection therewithin, an extension shelf on said bar support extending outwardly of said groove for supporting a part of said printing blanket thereon in spaced relation from said projection, and quick attach means for attaching and detaching said holding bar in said bar support; said bearing surface of said projection serving to carry loads applied against said blanket which tend to pull said holding bar out of said bar support; said projection being the sole means holding said holding bar and blanket against movements tending to pull said end portion of said blanket outwardly of said groove.

2. Apparatus as set forth in claim 1 in which said bearing surface is disposed substantially coplanar with a plane adjoining the end surfaces of said legs.

3. Apparatus as set forth in claim 1 in which said extension shelf has a blanket supporting surface disposed outwardly of said groove such that with said holding bar attached in said bar support with said end portion of said blanket disposed in its channel said blanket supporting surface is disposed substantially coplanar with the inside surface of said blanket.

4. Apparatus as set forth in claim 3 in which said blanket supporting surface of said extension shelf has a terminal end portion extending in a curved path which defines a curved surface.

5. Apparatus as set forth in claim 1 in which said quick attach means comprises an eccentric means rotatably mounted on said bar support.

6. Apparatus as set forth in claim 5 in which said eccentric means comprises an eccentrically mounted rotatable circular disc, said disc being rotatable into one position for engagement with said holding bar and being rotatable substantially 180° from said one position to move same out of engagement with said holding bar to facilitate removal of said holding bar from said bar support.

7. Apparatus as set forth in claim 5 in which said holding bar and bar support are made of metallic material.

8. Apparatus as set forth in claim 7 in which said bar support is defined as a single piece structure having said eccentric means rotatably mounted thereon.

9. Apparatus as set forth in claim 6 in which said eccentrically mounted disc is mounted on one of said arms for rotation about an axis perpendicular to the bight associated with the said one arm, and said extension shelf extends from the other of said arms.

10. Apparatus as set forth in claim 9 in which said eccentrically mounted circular disc is rotatably mounted on a shaft extending through said one of said arms.

11. Apparatus as set forth in claim 9 in which said disc has means providing high friction upon engagement of said disc against said holding bar.

12. Apparatus as set forth in claim 11 in which said means providing said high friction of said disc comprises a knurled cylindrical portion defining a part of the outside surface of said disc.

13. Apparatus as set forth in claim 12 and further comprising a pair of parallel ledges on said disc for receiving a tool thereagainst for forcibly rotating said disc into and out of clamping frictional engagement with its holding bar.

* * * * *